US007017782B2

(12) United States Patent
Harrold

(10) Patent No.: US 7,017,782 B2
(45) Date of Patent: Mar. 28, 2006

(54) CHILD RESISTANT SAFETY CAP FOR APPLICATOR TUBES

(76) Inventor: John E. Harrold, 27 Milford Rd., Bloomsbury, NJ (US) 08804

( * ) Notice: Subject to any disclaimer, the term of this patent is extended or adjusted under 35 U.S.C. 154(b) by 227 days.

(21) Appl. No.: 10/661,134

(22) Filed: Sep. 12, 2003

(65) Prior Publication Data

US 2005/0072792 A1 Apr. 7, 2005

(51) Int. Cl.
*B67D 5/32* (2006.01)

(52) U.S. Cl. ..... 222/153.1; 222/562; 215/222; 215/330; 215/342; 215/344

(58) Field of Classification Search ..... 222/562, 222/153.1, 153.14; 215/344, 330, 342, 222
See application file for complete search history.

(56) References Cited

U.S. PATENT DOCUMENTS 2,964,207 A * 12/1960 Towns ..... 215/220
3,716,161 A 2/1973 Julian et al.
4,121,727 A 10/1978 Robbins et al.
5,042,690 A 8/1991 O'Meara
5,161,706 A 11/1992 Weinstein
5,228,583 A 7/1993 Weinstein
6,045,003 A 4/2000 Seidler
6,065,648 A * 5/2000 Tauber ..... 222/153.14
6,082,565 A 7/2000 Harrold
6,095,375 A * 8/2000 Adams et al. ..... 222/182
6,378,713 B1 * 4/2002 Montgomery ..... 215/222
6,450,352 B1 * 9/2002 DeJonge ..... 215/330

* cited by examiner

*Primary Examiner*—Philippe Derakshani
(74) *Attorney, Agent, or Firm*—Kenneth P. Glynn

(57) ABSTRACT

A child resistant safety cap device for applicator tubes includes a base element, a cap, at least one keyway latching system, and at least one spring. The base element has a top and a sidewall, and has a container tube attachment mechanism located under the top that is adapted to affix the base element to a container tube. The top has a content outlet and an elongated applicator nozzle at the content outlet that extends upwardly therefrom. The cap is adapted to fit onto the base element. It has an upper portion with a top and a sidewall and a lower portion with a downward extension of the sidewall. The upper portion includes an applicator nozzle sealing mechanism to seal the applicator nozzle when the cap is in a closed position. There is at least one keyway latching system that includes a track having a downward entry section and an upward locking section, and includes a track rider corresponding to the track. One of the track and the track rider is located on the outside of the base element sidewall and the other is located on the inside of the cap lower portion sidewall, and they are positioned relative to one another to operate cooperatively. A spring biases the cap upwardly when closed.

20 Claims, 4 Drawing Sheets

CHILD RESISTANT SAFETY CAP FOR APPLICATOR TUBES

BACKGROUND OF THE INVENTION

1. Field of the Invention

The present invention relates to applicator tubes for dispensing various fluid materials, such as liquids, pastes, emulsions, etc. More particularly, the present invention is directed to a child resistant safety cap for applicator tubes that relies upon intelligence rather than strength for its operation.

2. Information Disclosure Statement

The following United States patents represent the prior art in the general area of safety caps for containers:

U.S. Pat. No. 3,716,161 describes a safety closure for a medicine bottle or the like. The closure and bottle neck have cooperating lug and ramp means of the bayonet type. The closure is placed over the bottle neck, depressed into the neck and rotated relative to the neck to engage the lugs and ramps. To remove the closure, it is pressed downwardly to disengage the lugs and then rotated in the opposite direction. The closure is biased upwardly relative to the bottle neck by the engagement of an annular conical shoulder on the closure with upwardly turned fingers on a disc-like biasing element that is positioned between the top of the closure and the end of the bottle neck.

U.S. Pat. No. 4,121,727 describes a vial construction including a vial body portion, an open end on said body portion, a tapered rim surrounding said open end, a plug having an entry portion on the body portion adjacent to the tapered rim, an interference fit between the entry portion to render the connection therebetween fluid tight, a locking ring mounted on the outside of the rim and having a flange extending over the rim toward the open end of the container, cam locking members engageable with the flange to lock the plug to the flange, and a cutaway portion on the flange to permit disengagement between the flange and the cam locking members when the plug is rotated to a predetermined circumferential position on the locking ring.

U.S. Pat. No. 5,042,690 describes a cap and tube assembly device including a tube with a nozzle mounted on one end of the tube and having a thin wall section puncturable to provide a discharge on the other end of the nozzle. Also provided is a cap having a first end with an inside cross section sized to engage the nozzle and having an axially centered punctured spike positioned in a first position spaced from the thin wall and movable to a second position to puncture the thin wall. The puncture spike has a chisel shaped edge for forming a hole in the wall and a central bore for providing access to the contents of the tube. The cap has a second end enclosing an applicator for dispensing the contents of the tube, whereby the contents of the tube is transferred to the applicator through the bore of the puncture means.

U.S. Pat. No. 5,161,706 describes a twist and push snap-on, child restraint cap and container that has an inner cap seal which is easily snapped onto a neck of a container and an outer cap. The outer cap has a top and sidewalls and has a greater cross-sectional area than the inner cap, and receives and physically restrains the inner cap within the outer cap such that the inner cap may be moved upwardly and downwardly within it over specified distance. The outer cap includes a locking lug located on its inside wall adapted to snap over a circumferential bead located on the neck of the container. There is a stop located on the inside wall of the outer cap and is freely rotatable about the neck of the container except when in contact with stop(s) on the neck of the container at its level of rotation when the outer cap is on the container. A spring mechanism is located between the inner and outer cap so as to bias downwardly the inner cap. There is a bead located circumferentially about its neck with a break to allow the lug and stop of the outer cap to pass therethrough. The first stop is located on the neck near but not above or below the opening in the bead and a second stop, larger than the first, is capable of preventing movement of the outer cap when rotated with its stop against its second stop.

U.S. Pat. No. 5,228,583 describes a present invention that involves a child restraint closure for containers with threaded necks. It involves an inner cap and an outer cap with engages with one another by ratchets in order to close but these ratchets do not engage when an attempt is made to open the closure. The inner cap and the outer cap are generally cylindrical and have sides and a top, although the outer cap may have an open top. The inner cap has threads on its inside and is adapted to non-removably receive the outer cap so that the outer cap is rotatably engaged therewith. The outer cap is non-removably but rotatably mounted on an engaged with the inner cap. At least one keyway slot is located either on the outside of the inner cap or the inside of the outer cap and there is at least one keyway protrusion extending toward the keyway slot and located on whichever of the inner cap and the outer cap does not contain the slot. There are indexes on each of the caps and when they are aligned, the keyway protrusion and the keyway slot are to be aligned. The user will align the indexes or indicia and then lift up so that the protrusion fits into the keyway slot. In this manner, the outer cap engages the inner cap so that they are simultaneously rotated for opening. Upon closure, the protrusion will be pushed or dropped out of the slot and the ratchets will engage for proper closure.

U.S. Pat. No. 6,045,003 describes a liquid dosage dispenser includes a bottle having a housing or sleeve extending into the bottle and a plunger device having a through passageway extending into the housing for longitudinal movement therein. The housing includes an opening through which the liquid in the bottle can be drawn into the housing. A helical channel and one or more vertical channels are provided in the housing. The plunger device is rotatable within the housing to permit a follower extending from the plunger device to ride in the helical channel to move the plunger longitudinally in the housing. As the plunger moves upwardly within the housing, a preselected amount of liquid is drawn into the housing. When the follower is positioned in a vertical channel associated with a desired dosage level, the plunger may be forced downwardly to deliver the desired dosage through the passageway and out of the dispenser. Indents are provided along the helical channel at various vertical channel positions. When the follower encounters an indent, it snaps into the indent to indicate that a preselected dosage of liquid is available to be dispensed.

U.S. Pat. No. 6,082,565 describes an invention that is a child resistant cap and dispenser. It includes a dispensing container, a flange located nonrotatably connected on the container neck with one-way ratchets located thereon, said flange being non-rotatably connected to said container neck with one-way ratchets located thereon, in functional and cooperative contact with the flange ratchets to permit rotation of it about the neck in one direction and so as to prevent rotation in the opposite direction. The ring collar has an outer circular wall, with one of (i) at least one keyway track, and (ii) at least one keyway protrusion located thereon, the other being located on a cap, adapted to fit into the said ring collar. There is a spring mechanism located on at least one of the necks, the collar and the cap, to bias the cap upwardly away from the dispensing container when the cap is connected to the ring collar.

Notwithstanding the prior art, the present invention is neither taught nor rendered obvious thereby.

SUMMARY OF THE INVENTION

The present invention relates to a child resistant safety cap device for applicator tubes, as well as the combination of a cap device and tube. The cap device includes a base element, a cap, at least one keyway latching system, and at least one spring.

The base element has a top and a sidewall, and has a container tube attachment mechanism located under the top that is adapted to affix the base element to a container tube. The top has a content outlet located thereon and an elongated applicator nozzle at the content outlet that extends upwardly therefrom away from the container tube attachment mechanism.

The cap is adapted to fit onto the base element. It has an upper portion and a lower portion. The upper portion includes a top and a sidewall; the lower portion includes a downward extension of the sidewall. The upper portion includes an applicator nozzle sealing means under its top that is adapted to seal the applicator nozzle when the cap is attached to the base element in a closed position.

There is at least one keyway latching system, and, in many preferred embodiments, there are two or more keyway latching systems. Each keyway latching system includes a track having a downward entry section and an upward locking section, and includes a track rider corresponding to the track. One of the track and the track rider is located on the outside of the base element sidewall and the other is located on the inside of the cap lower portion sidewall, and they are positioned relative to one another to operate cooperatively.

There is at least one spring connected to one of the cap and the base element and positioned so as to push upwardly against the cap and to bias the cap away from the base element when the cap is in a closed position. Thus, the cap has a closed position when the cap has been pushed downwardly onto the base element and rotated to engage the track rider with the track and to move the track rider into the upward locking section, and further wherein, when the cap is in the closed position, it cannot be removed from the base element by rotation unless it is pushed down and rotated.

In some embodiments of the present invention child resistant safety cap device for applicator tubes, the spring is connected to the cap. For example, the child resistant safety cap device spring is connected inside the sidewall of the cap at its lower portion. Alternatively, the child resistant safety cap spring is connected to the base element. For example, the child resistant safety cap spring is connected to the elongated applicator nozzle of the base element. In some preferred embodiments, there are two springs, and these springs are advantageously opposite one another. In some embodiments, the springs are connected to the elongated applicator nozzle of the base element.

It is important that at least a portion of the outside of the base element that includes a keyway component be sufficiently circular to permit engagement and disengagement of the corresponding keyway component on the inside of the cap. Likewise, the inside sidewall of the cap must be correspondingly sufficiently circular to have the keyway system function properly via movement that includes circular rotation. Thus, these components could be completely circular on their outside and inside, respectively, or could merely have critical functional areas circular or curved to permit keyway functioning.

The child resistant safety cap lower portion of the sidewall of the cap may include an internal cross section that is greater than an internal cross section of the upper portion of the sidewall of the cap. This is particularly important when the spring or springs are located on the base element and a pressure shoulder is created between the upper portion and lower portion of the cap for engagement of the spring.

In many present invention preferred embodiments, the child resistant safety cap outside sidewall of the base element and the inside sidewall of at least the lower portion of the sidewall of the cap have circular top views.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
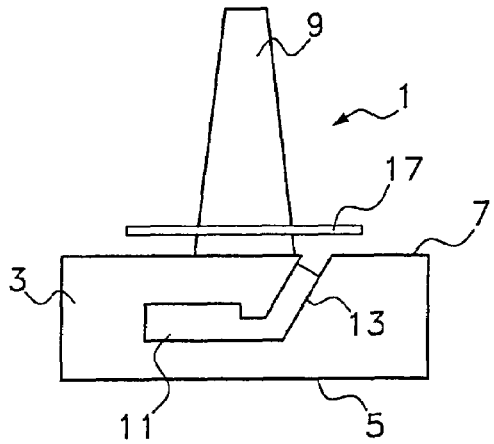
FIG. 1 shows a front view of one embodiment of a base element of the present invention child resistant safety cap device for applicator tubes.
Figure 2:
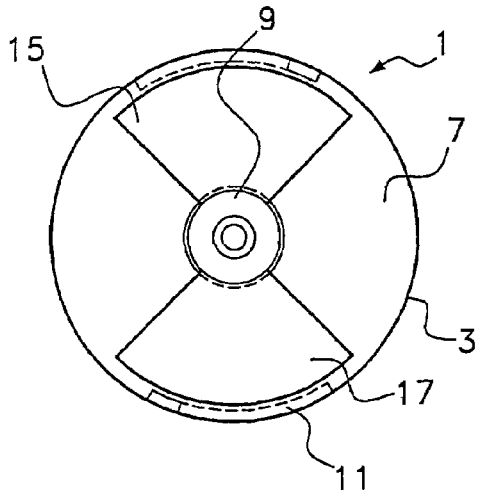
FIG. 2 shows a side cut view of the base element of the present invention child resistant safety cap device shown in FIG. 1.

FIG. 1 shows a front view of one embodiment of a base element 1 of the present invention child resistant safety cap device for applicator tubes, and FIG. 2 shows a top view thereof. These two Figures will be described together. Base element 1 includes a sidewall 3, an open bottom 5, and a top 7. This is generally cylindrical in shape from a top view, although it could be arcuated, elliptical, oval or cut and segmented (e.g. a polygon with thirty six sides) and still function as described below. Top 7 has an elongated applicator nozzle 9 extending upwardly therefrom and is hollow including through the top 7 itself, so that the desired material in the tube to which it may be attached, may be dispensed therethrough. Also, in this preferred embodiment, the nozzle 9 includes two laterally extending springs 15 and 17, that bias a cap connected thereto upwardly. This will be more fully shown in conjunction with the Figures described below. Also located on sidewall 3 of base element 1 are two opposite keyway latching system tracks, one of these shown here as track 11. Track 11 has a downward entry section 13 located at its open end and an upward locking section at its lower end. A set of corresponding track riders are located on a corresponding cap, such as cap 50 of FIG. 5 below.

Figure 3:
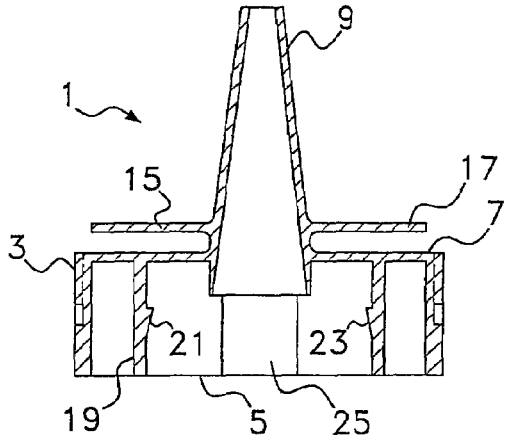
FIG. 3 shows a side cut view of the base element of the present invention shown in FIGS. 1 and 2.
Figure 4:
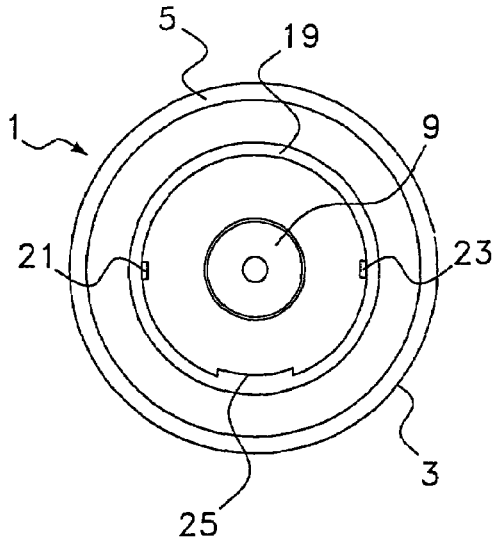
FIG. 4 shows a bottom view of the same base element.

FIG. 3 shows a side cut view of the base element 1 of the present invention shown in FIGS. 1 and 2, and FIG. 4 shows a bottom view of the same base element 1. In other words, these two Figures show the same device as in FIGS. 1 and 2 above, but the device has been rotated ninety degrees from front to side to further illustrate the invention, otherwise identical components are numbered identically as described above.

Referring now to both FIGS. 3 and 4, base element 1 includes means for affixing it to a tube so that it cannot be easily removed or rotated. Any means could be used, such as one way ratchet screwing, heat welding, gluing or any other manner. As shown here, base element 1 includes an inside annular member 19 for attachment to a tube. Annular member 19 has a raised positioning guide block 25 and two snap ratchets 21 and 23. When base element 1 is fitted onto a tube, block 25 prevents rotation, and snap ratchets 21 and 23 prevent upward movement and hence prevent removal of base element from a tube.

Figure 5:
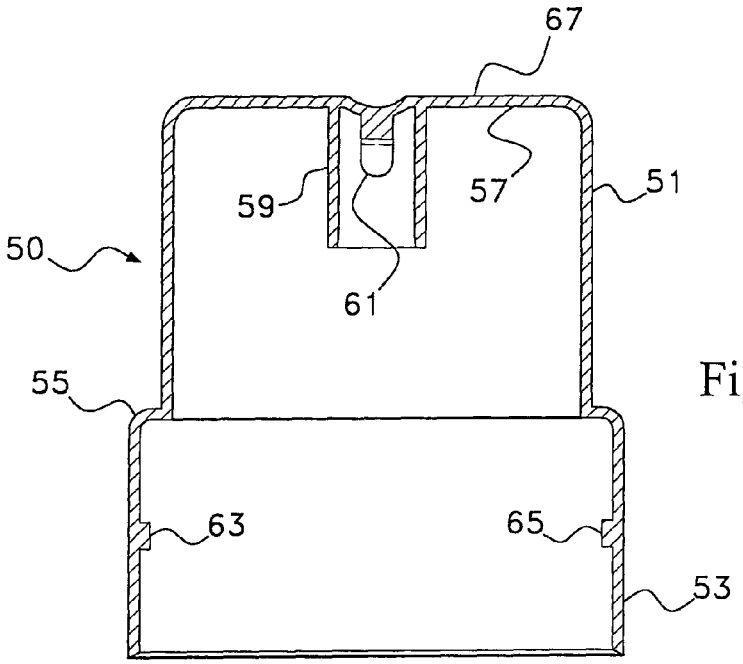
FIG. 5 shows a cut side view of a cap of a present invention device that is coincidental with the base element above.

FIG. 5 shows a cut side view of a cap 50 of a present invention device that is coincidental with the base element 1, described above. It is usually generally cylindrical, although similar shapes that would not inhibit its functionality could be used. The cap 50 has an upper portion 51 and a lower portion 53, with lower portion 53 having a greater diameter than upper portion 51, so as to establish a shoulder 55, as shown. There is an open bottom 69, a top 67 and track riders 63 and 65. The track riders 63 and 65 move onto tracks such as track 11 of FIG. 1 to secure the cap 50 to the base element. The inside top 57 has a pintal 61 (insert sealing rod) for insertion into a nozzle such as nozzle 9 to seal it when the cap is attached to the base element. Surrounding pintal 61 is an optional but preferred guide shroud to assist in alignment of pintal 61 and nozzle 9 during attachment of the cap.

The shoulder 55 is dimensioned so as to contact and press down on springs 15 and 17 of FIG. 1, while the riders 63 and 65 ride the tracks and lock in. The springs bias the cap upwardly to keep the riders from slipping out of their tracks.

Figure 6:
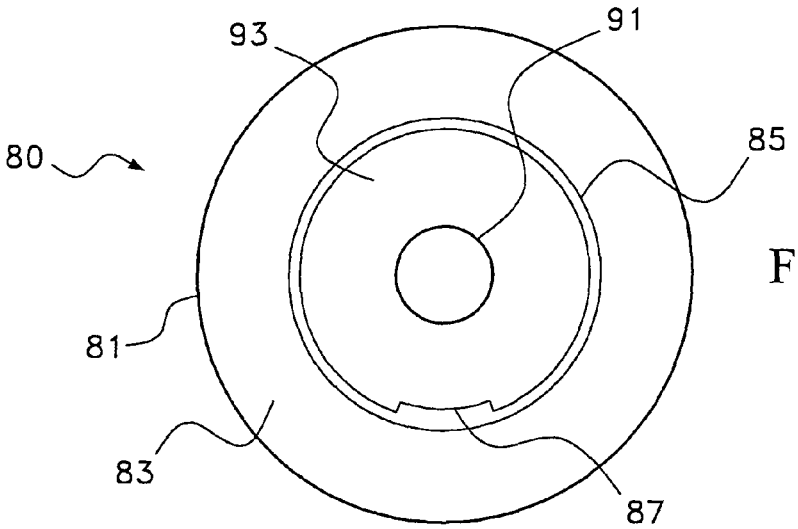
FIG. 6 and FIG. 7 illustrate top and side views of a squeeze tube that is used in conjunction with the present invention device.
Figure 7:
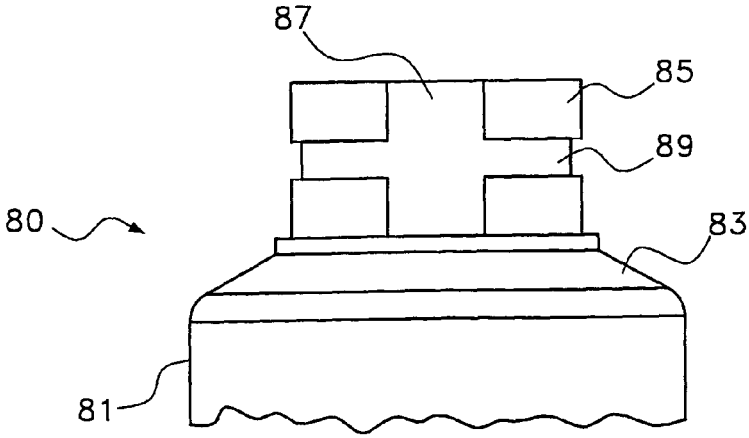

FIG. 6 and FIG. 7 illustrate top and side views of a squeeze tube 80 that represents one embodiment of a tube that is used in conjunction with the present invention devices such as the base element 1 and the cap 50 described above. It includes a typical main tube contents holding section 81, and a shoulder 83. Here, neck 85 has a vertical slot 87 on its outside for receiving block 25 (FIG. 3), and has a horizontal groove 89 for receiving the ratchet snaps 21 and 23 (FIG. 3) to lock the base element 1 to the tube 80 and to prevent rotation of the base element 1 on the tube 80. The gel, paste or other tube content exits through outlet 91 of top 93, and into and out of nozzle 9, as it would for any dispensing tube with a nozzle. In the present invention, however, the tube contents are secure from child misuse, and a complex movement (downward push and rotation) is necessary to open the cap.

Figure 8:
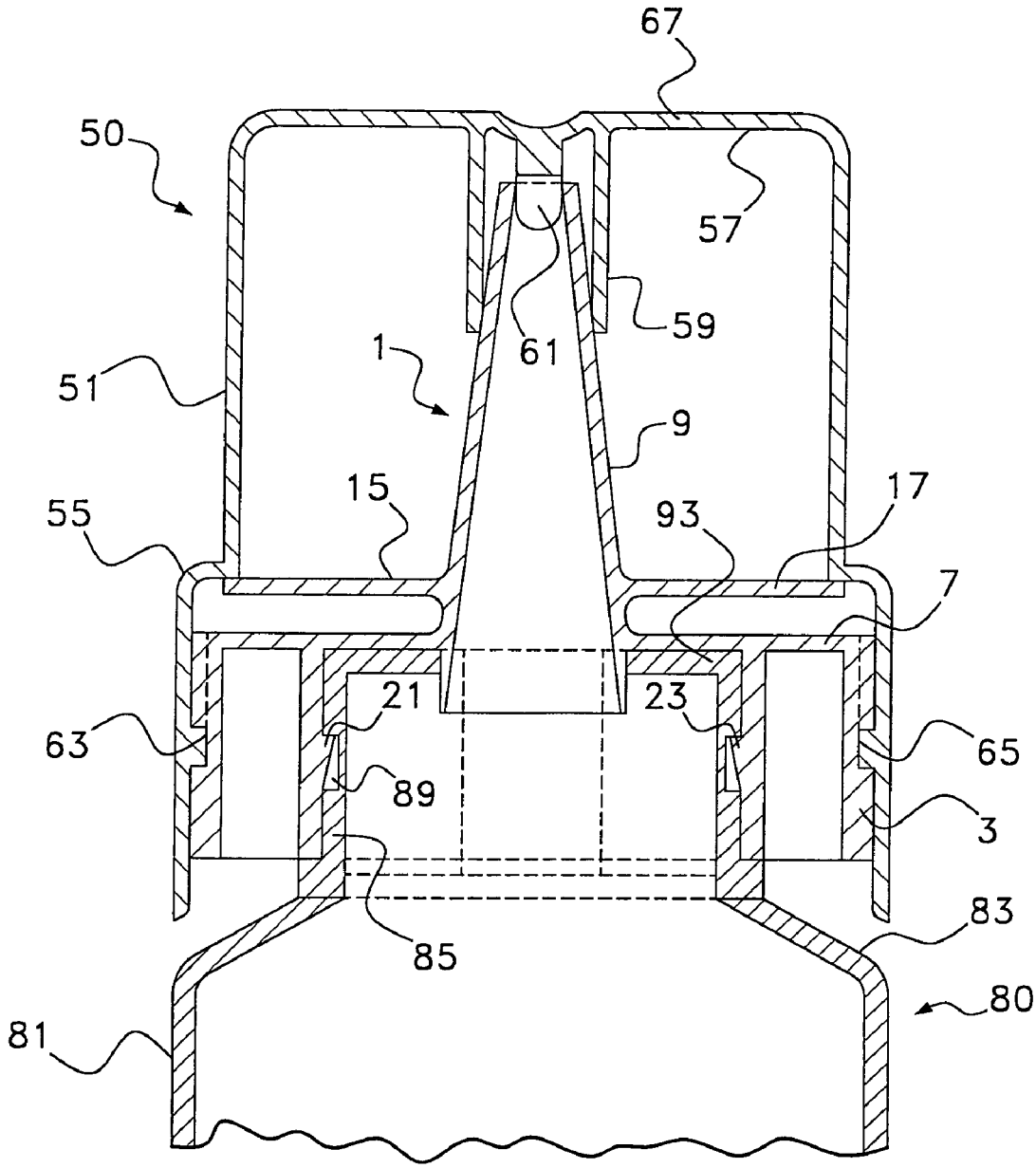
FIG. 8 illustrates the present invention base element and cap and the tube above, in its assembled and locked position.

FIG. 8 illustrates the present invention base element 1 and cap 80, in its assembled and locked position on tube 80. All of the components are described above and are identically numbered. As can be seen here, springs 15 and 17 push cap 50 upwardly to secure riders 63 and 65 in their tracks, and pintal 61 seals nozzle 9.

Figure 9:
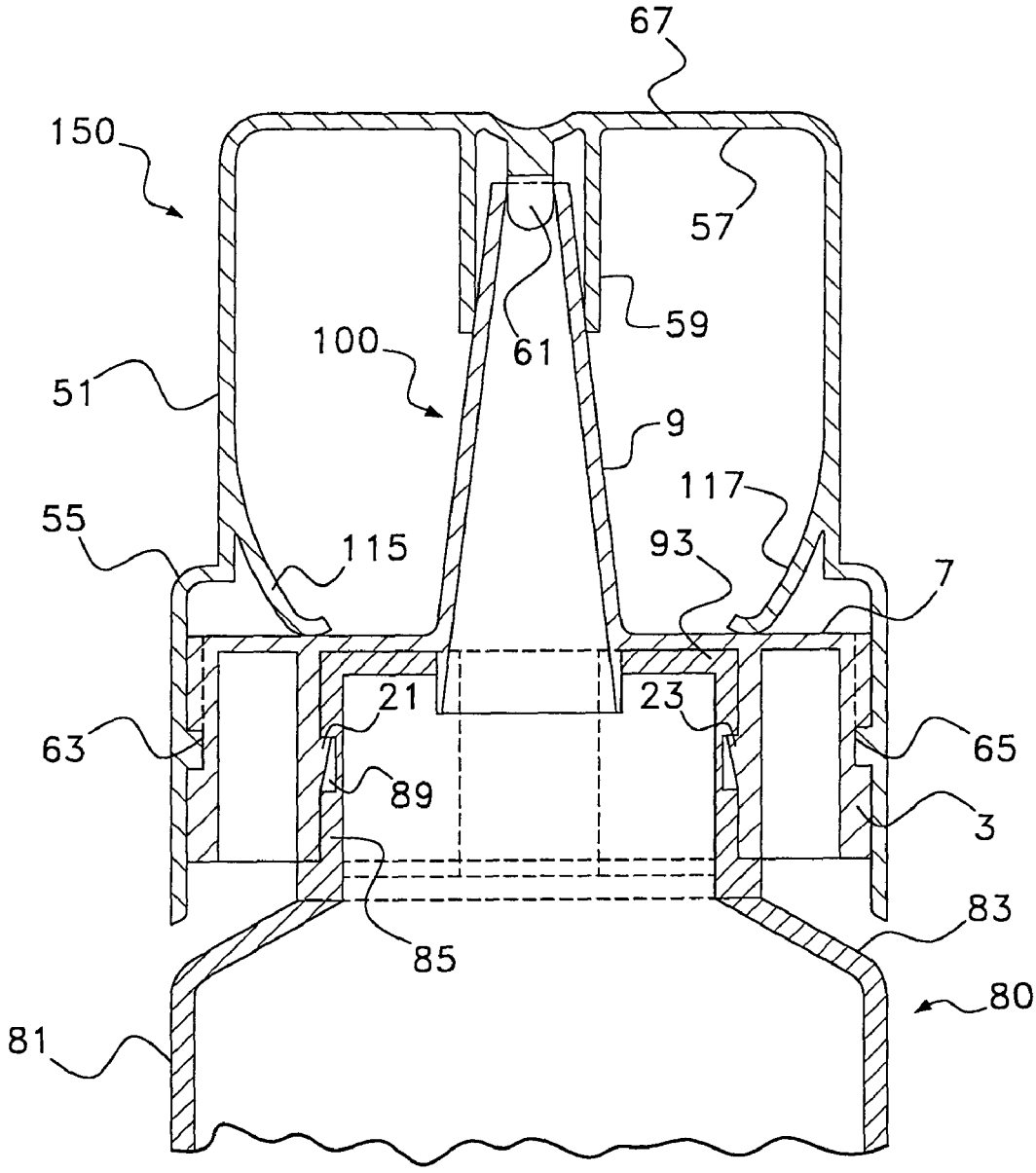
FIG. 9 shows an alternative embodiment base element and cap present invention device wherein the spring is connected to the cap instead of the base element.

FIG. 9 shows an alternative embodiment base element 100 and cap 150 present invention device wherein the springs 115 and 117 are connected to the cap 150 instead of the base element, as shown in the previous Figure. Otherwise, the parts are identical to the previous Figure, are identically numbered, and need not be described again here.

Obviously, numerous modifications and variations of the present invention are possible in light of the above teachings. For example, one track and one track rider, or three tracks and three track riders, could be used. Or, for example, two track riders could be used and four tracks could be used to makes the connection quicker. Or, for example, the track could be on the inside of the cap and the track rider could be on the outside of the base element. It is therefore understood that within the scope of the appended claims, the invention may be practiced otherwise than as specifically described herein.

What is claimed is:

1. A child resistant safety cap device for applicator tubes, which consists of:

(a) a base element, said base element having a top and a sidewall, and having a container tube attachment mechanism located under said top and adapted to affix said base element to a container tube, said top having a content outlet located thereon and an elongated applicator nozzle at said content outlet and extending upwardly therefrom away from said container tube attachment mechanism;

(b) a cap, adapted to fit onto said base ekment, said cap having an upper portion and a lower portion, said upper portion including a top and a sidewall, said lower portion including a downward extension of said sidewall, said upper portion including an applicator nozzle sealing means under its top, and adapted to seal said applicator nozzle when said cap is attached to said base element in a closed position;

(c) at least one keyway latching system, said keyway latching system including a track having a downward entry section and an upward locking section, and including a track rider corresponding to said track, one of said track and said track rider being located on the outside of said base element sidewall and the other being located on the inside of said cap lower portion sidewall, and positioned to operate cooperatively;

(d) at least one spring connected to said cap and positioned so as to push upwardly against said cap and to bias said cap away from said base element when said cap is in a closed position, wherein said at least one spring is connected inside said sidewall of said cap at its lower portion;

wherein, said cap has a closed position when said cap has been pushed downwardly onto said base element and rotated to engage said track rider with said track and to move said track rider into said upward locking section, and further wherein, when said cap is in said closed position, it cannot be removed from said base element by rotation unless it is pushed down and rotated.

2. The child resistant safety cap device for applicator tubes of claim 1 wherein there are two springs, and said springs are opposite one another.

3. The child resistant safety cap device for applicator tubes of claim 1 wherein said lower portion of said sidewall of said cap includes an internal cross section that is greater than an internal cross section of said upper portion of said sidewall of said cap.

4. The child resistant safety cap device for applicator tubes of claim 1 wherein the outside sidewall of said base element and the inside sidewall of at least the lower portion of said sidewall of said cap have circular top views.

5. A child resistant safety cap device for applicator tubes, which consists of:

(a) a base element, said base element having a top and a sidewall, and having a container tube attachment mechanism located under said top and adapted to affix said base element to a container tube, said top having a content outlet located thereon and an elongated applicator nozzle at said content outlet and extending upwardly therefrom away from said container tube attachment mechanism;

(b) a cap, adapted to fit onto said base element, said cap having an upper portion and a lower portion, said upper portion including a top and a sidewall, said lower portion including a downward extension of said sidewall, said upper portion including an applicator nozzle sealing means under its top, and adapted to seal said applicator nozzle when said cap is attached to said base element in a closed position;

(c) at least one keyway latching system, said keyway latching system including a track having a downward entry section and an upward locking section, and including a track rider corresponding to said track, one of said track and said track rider being located on the outside of said base element sidewall and the other being located on the inside of said cap lower portion sidewall, and positioned to operate cooperatively;

(d) at least one spring connected to said base element and positioned so as to push upwardly against said cap and to bias said cap away from said base element when said cap is in a closed position;

wherein, said cap has a closed position when said cap has been pushed downwardly onto said base element and rotated to engage said track rider with said track and to move said track rider into said upward locking section, and further wherein, when said cap is in said closed position, it cannot be removed from said base element by rotation unless it is pushed down and rotated.

6. The child resistant safety cap device for applicator tubes of claim 5 wherein said at least one spring is connected to said base element so as to be in a horizontal rest position.

7. The child resistant safety cap device for applicator tubes of claim 6 wherein said at least one spring is connected to said elongated applicator nozzle of said base element.

8. The child resistant safety cap device for applicator tubes of claim 6 wherein there are two springs, and said springs are opposite one another.

9. The child resistant safety cap device for applicator tubes of claim 8 wherein said two springs are connected to said elongated applicator nozzle of said base element.

10. The child resistant safety cap device for applicator tubes of claim 5 wherein the outside sidewall of said base element and the inside sidewall of at least the lower portion of said sidewall of said cap have circular top views.

11. The child resistant safety cap device and applicator tube of claim 5 wherein the outside sidewall of said base element and the inside sidewall of said cap includes an internal cross section that is greater than an internal cross section of said upper portion of said sidewall of said cap.

12. A child resistant safety cap device and applicator tube, which consists of:

(a) a base element attached to an applicator tube, said base element having a top and a sidewall, and having a container tube attachment mechanism located under said top and adapted to affix said base element to a container tube, said top having a content outlet located thereon and an elongated applicator nozzle at said content outlet and extending upwardly therefrom away from said container tube attachment mechanism;

(b) a cap, adapted to fit onto said base element, said cap having an upper portion and a lower portion, said upper portion including a top and a sidewall, said lower portion including a downward extension of said sidewall, said upper portion including an applicator nozzle sealing means under its top, and adapted to seal said applicator nozzle when said cap is attached to said base element in a closed position;

(c) at least one keyway latching system, said keyway latching system including a track having a downward entry section and an upward locking section, and including a track rider corresponding to said track, one of said track and said track rider being located on the outside of said base element sidewall and the other being located on the inside of said cap lower portion sidewall, and positioned to operate cooperatively;

(d) at least one spring connected to one of said cap and said base element and positioned so as to push upwardly against said cap and to bias said cap away from said base element when said cap is in a closed position;

(e) said applicator tube;

wherein, said cap has a closed position when said cap has been pushed downwardly onto said base element and rotated to engage said track rider with said track and to move said track rider into said upward locking section, and further wherein, when said cap is in said closed position, it cannot be removed from said base element by rotation unless it is pushed down and rotated.

13. The child resistant safety cap device and applicator tube of claim 12, wherein said at least one spring is connected to said cap.

14. The child resistant safety cap device and applicator tube of claim 13, wherein said at least one spring is connected inside said sidewall of said cap at its lower portion.

15. The child resistant safety cap device and applicator tube of claim 12 wherein said at least one spring is connected to said base element.

16. The child resistant safety cap device and applicator tube of claim 15 wherein said at least one spring is connected to said elongated applicator nozzle of said base element.

17. The child resistant safety cap device and applicator tube of claim 15 wherein there are two springs, and said springs are opposite one another.

18. The child resistant safety cap device and applicator tube of claim 12 wherein said two springs are connected to said elongated applicator nozzle of said base element.

19. The child resistant safety cap device and applicator tube of claim 12 wherein said lower portion of said sidewall of said cap includes an internal cross section that is greater than an internal cross section of said upper portion of said sidewall of said cap.

20. The child resistant safety cap device and applicator tube of claim 18 wherein said lower portion of said sidewall of said cap includes an internal cross section that is greater than an internal cross section of said upper portion of said sidewall of said cap.

* * * * *